US007281292B1

(12) United States Patent
Felix

(10) Patent No.: US 7,281,292 B1
(45) Date of Patent: Oct. 16, 2007

(54) COMBINATION PAINT ROLLER FRAME AND SCRAPER

(76) Inventor: John J. Felix, 1111 Berenice Dr., Brea, CA (US) 92821

( * ) Notice: Subject to any disclaimer, the term of this patent is extended or adjusted under 35 U.S.C. 154(b) by 0 days.

(21) Appl. No.: 11/707,081

(22) Filed: Feb. 16, 2007

Related U.S. Application Data

(60) Provisional application No. 60/773,689, filed on Feb. 16, 2006.

(51) Int. Cl.
*B05C 17/02* (2006.01)

(52) U.S. Cl. ..... 15/230.11; 492/13; 492/19

(58) Field of Classification Search ..... 15/230.11; 492/13, 19
See application file for complete search history.

(56) References Cited

U.S. PATENT DOCUMENTS

| | | | | |
|---|---|---|---|---|
| 2,820,290 | A | 1/1958 | Porter, Jr. | |
| 3,094,728 | A | 6/1963 | White | |
| 3,097,384 | A | 7/1963 | Clark | |
| 3,685,084 | A * | 8/1972 | Bennett | 15/230.11 |
| D257,521 | S | 11/1980 | Piero | |
| 4,317,248 | A | 3/1982 | Smith | |
| 4,517,700 | A | 5/1985 | Pinto | |
| 4,785,489 | A | 11/1988 | Von Doehren | |
| 5,502,864 | A | 4/1996 | Sorenson | |
| 5,890,259 | A | 4/1999 | Sarac | |
| D445,320 | S | 7/2001 | Abbott | |
| 6,640,369 | B1 | 11/2003 | Malvasio | |
| 2005/0011032 | A1 | 1/2005 | Bosler | |
| 2005/0050663 | A1 | 3/2005 | Goulet | |

FOREIGN PATENT DOCUMENTS

| | | |
|---|---|---|
| DE | 19627058 | 1/1998 |

* cited by examiner

*Primary Examiner*—Randall Chin
(74) *Attorney, Agent, or Firm*—Richard C. Litman

(57) ABSTRACT

The combination paint roller frame and scraper allows a painter to accomplish two tasks with a single tool and includes a paint roller frame, an elongated scraper member, and a hinge or pivot mechanism attaching the scraper to the paint roller frame. The paint roller frame is a standard frame having a roller cage assembly, a shaft for receiving the roller cage assembly, and a handle for supporting the shaft. The scraper member is an elongated scraper having a first end and a sharpened second end, with the first end being pivotally attached to a vertical portion of the shaft of the paint roller frame. The pivot mechanism attaching the scraper to the vertical portion of the shaft of the paint roller frame allows the scraper to be flipped between an "up" or "in use" position, and a "closed" or "not in use" position.

15 Claims, 3 Drawing Sheets

COMBINATION PAINT ROLLER FRAME AND SCRAPER

CROSS-REFERENCE TO RELATED APPLICATION

This application claims the benefit of U.S. Provisional Patent Application Ser. No. 60/773,689, filed Feb. 16, 2006.

BACKGROUND OF THE INVENTION

1. Field of the Invention

The present invention relates to painting tools, and more specifically to a paint roller frame with an attached, adjustable scraper.

2. Description of the Related Art

Commercial and residential painters are required to use many tools during the course of a normal day of work. These tools include paintbrushes, paint buckets, paint roller frames, and scrapers, among others. Oftentimes, the job requires that the painter climb a ladder in order to reach the workspace, which makes in difficult to carry all of the needed tools to that location. For example, if the area to be painted needs to be scraped down before it can be painted, the painter must climb the ladder with a scraper in hand and perform the scraping task, then retreat down the ladder to retrieve a paint roller before re-climbing the ladder to paint the desired area.

What is needed is a traditional paint roller that incorporates a scraper into the paint roller frame. It is desirable that the scraper be capable of flipping between an "up" or "in use" position, and a "closed" or "not in use" position. Thus, a combination paint roller frame and scraper solving the aforementioned problems is desired.

SUMMARY OF THE INVENTION

The combination paint roller frame and scraper includes a paint roller frame, an elongated scraper member, and a hinge or pivot mechanism for pivotally attaching the scraper to the paint roller frame. The paint roller frame is a standard frame having a roller cage assembly, a shaft for receiving the roller cage assembly, and a handle for supporting the shaft. The scraper member is an elongated scraper having a first end and a sharpened second end. The first end is pivotally attached to a vertical portion of the shaft of the paint roller frame. The hinge attaching the scraper to the vertical portion of the shaft of the paint roller frame allows the scraper to be flipped between an "up" or "in use" position, and a "closed" or "not in use" position.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
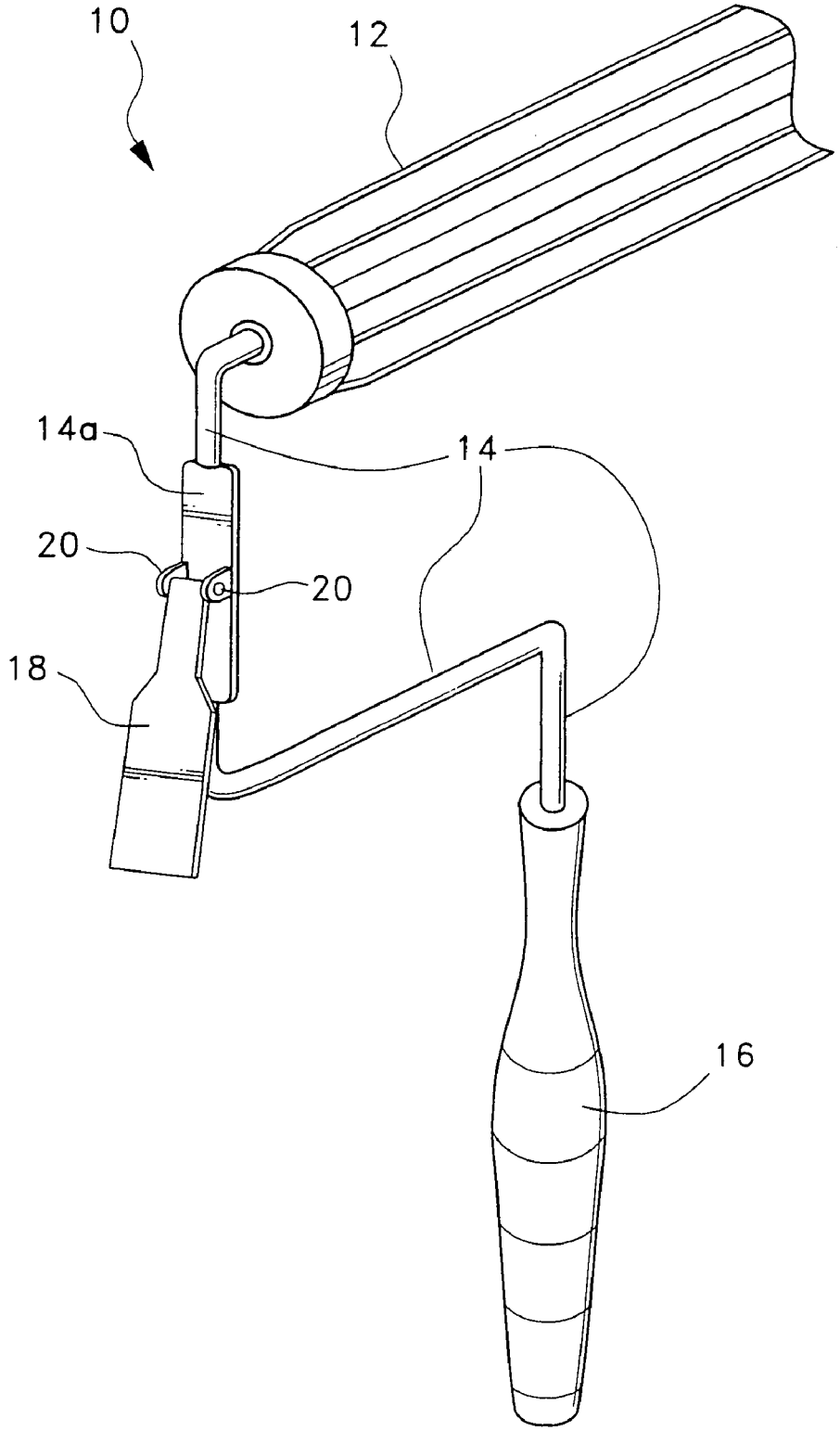
FIG. 1 is a perspective view of a combination paint roller frame and scraper according to the present invention with the scraper folded down.

The present invention is a combination paint roller frame and scraper, designated generally as 10 in the drawings.

Figure 2:
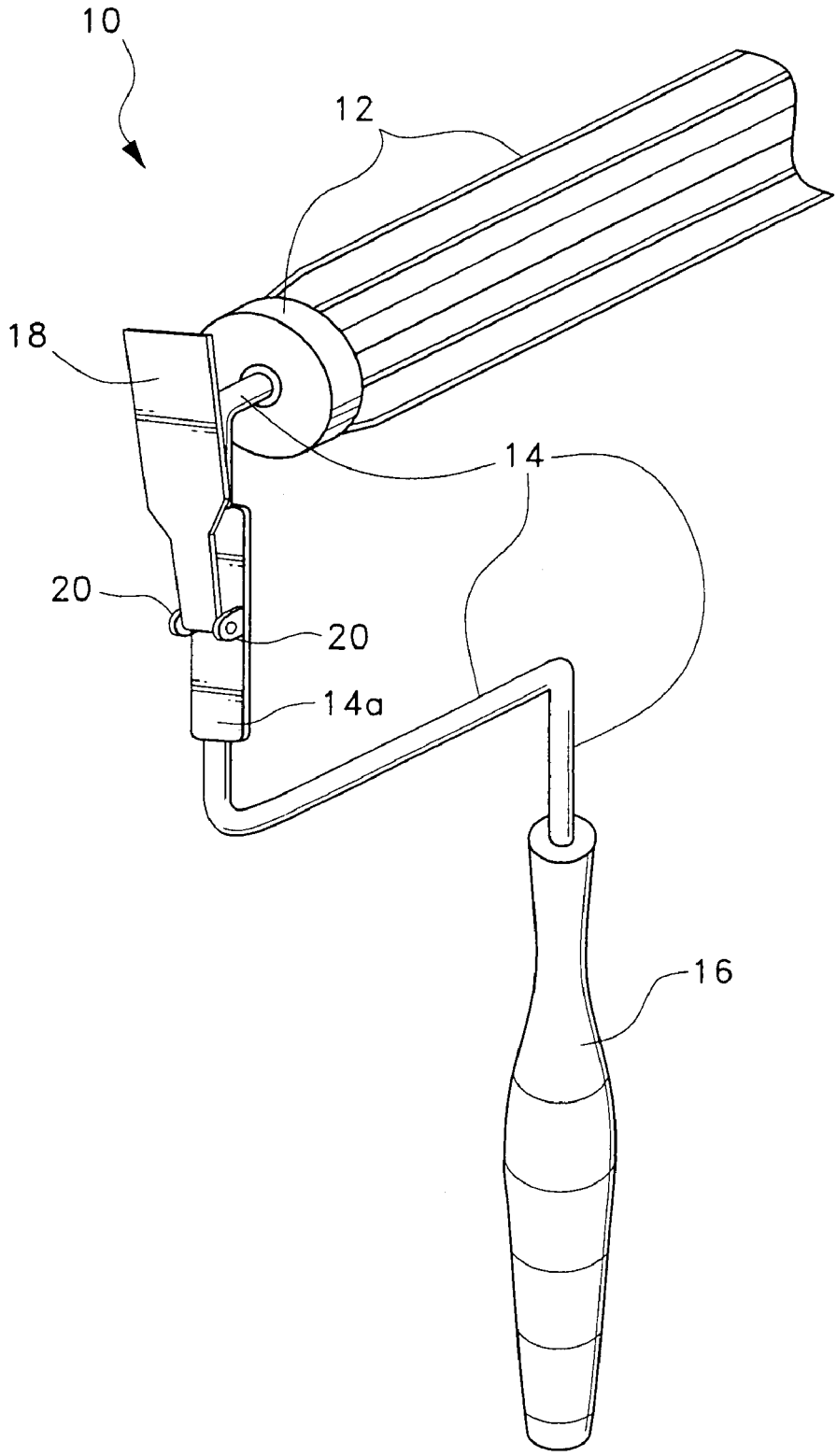
FIG. 2 is a perspective view of a combination paint roller frame and scraper according to the present invention with the scraper folded up.
Figure 3:
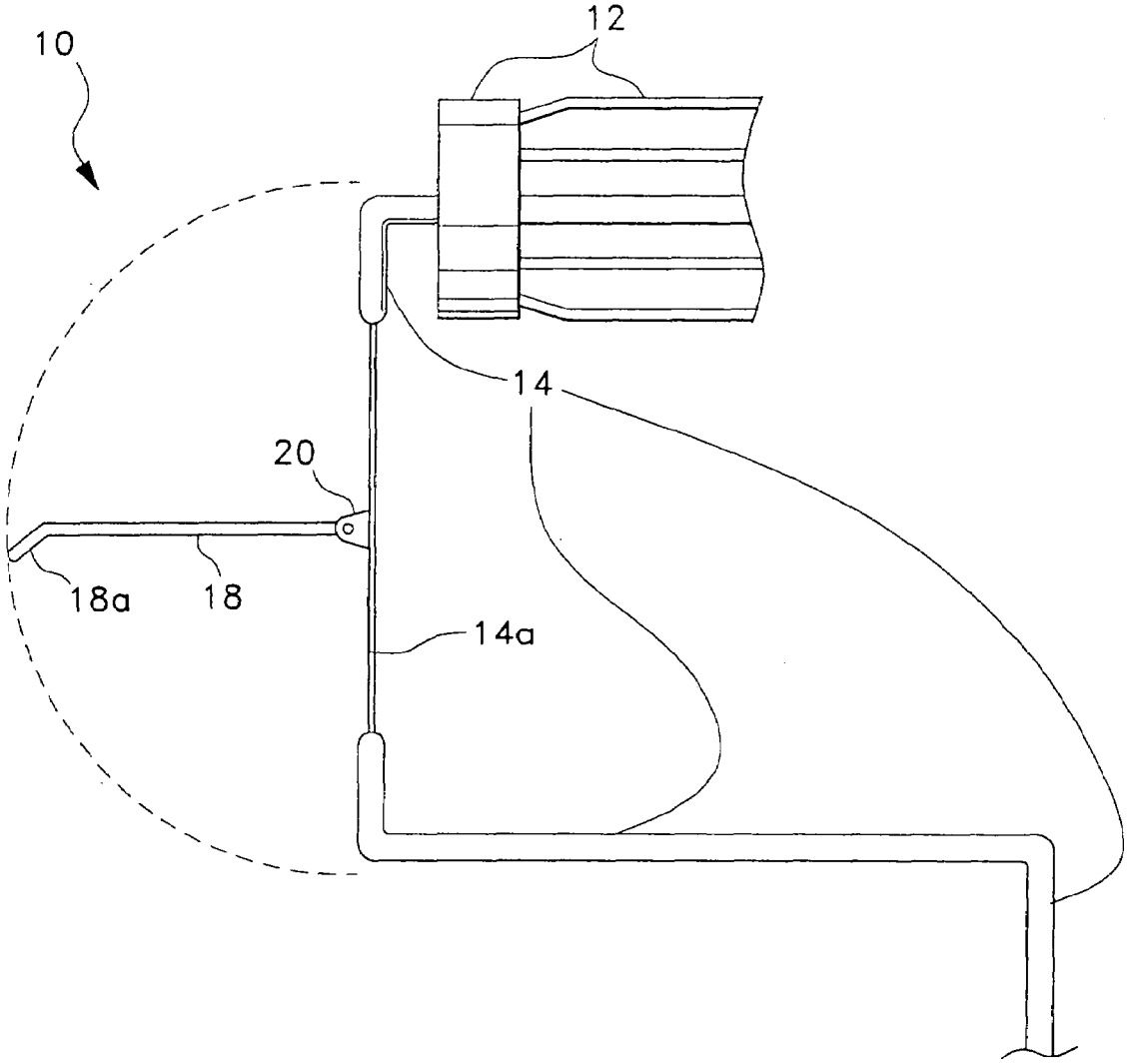
FIG. 3 is a partial front view of a combination paint roller frame and scraper according to the present invention showing an angled scraper blade pivoted 90° to the shaft of the paint roller frame.

Referring to FIGS. 1-3, the combination paint roller frame and scraper 10 is shown including a paint roller frame, an elongated scraper member 18, and a hinge 20 for pivotally attaching scraper member 18 to the paint roller frame. The paint roller frame is constructed in a similar manner as traditional paint roller frames and includes a roller cage assembly 12, a shaft 14 for receiving roller cage assembly 12, and a handle 16 for supporting shaft 14.

Elongated scraper member 18 has a first end and a sharpened second end 18*a*. The scraper 18 may be a flat, planar member, as shown in FIGS. 1 and 2, or may be bent so that the second end 18*a* forms a dihedral angle with the body of the scraper blade 18*a*. The first end is pivotally attached to a vertical portion of shaft 14 of the paint roller frame. Scraper 18 is pivotally connected to shaft 14 along a flat portion 14*a* of the shaft 14, which may be formed by forging or molding this leg of the shaft as a flat portion, or by welding or otherwise attaching a flat plate to the shaft 14 to provide a base for attachment of the hinge 20.

The hinge 20 allows scraper 18 to be flipped between an "up" or "in use" position, and a "closed" or "not in use" position. The hinge 20 is shown in the drawings having a pair of flanges or ears extending from the edges of flattened portion 14*a* of shaft 14, and a pivot pin, pintle, or hinge pin extending through the first end of the scraper and the opposing ears. However, it will be understood that the hinge 20 shown in the drawings is exemplary, and any hinge or pivot mechanism (e.g., a piano hinge) that permits the scraper 18 to pivot away from the shaft or above the roller cage 12 for use in scraping paint and to pivot flat against the shaft 14 to permit the roller to be used to apply paint to the wall may be used in lieu of the hinge 20 shown in the drawings.

It is to be understood that the present invention is not limited to the embodiments described above, but encompasses any and all embodiments within the scope of the following claims.

I claim:

1. A combination paint roller frame and scraper, comprising:

a paint roller frame having a roller cage assembly, a handle, and a shaft connecting the roller cage assembly to the handle, the shaft having a vertical leg parallel to the handle supporting one end of the roller cage assembly;

an elongated scraper member having a first end and a sharpened second end; and a hinge pivotally attaching the first end of the scraper member to the vertical leg of the shaft, the scraper member pivoting between an open position for use of the combination as a scraper and a closed position for use of the combination as a paint roller.

2. The combination paint roller frame and scraper according to claim 1, wherein the vertical leg of said shaft has a flattened portion, said hinge being attached to the flattened portion.

3. The combination paint roller frame and scraper according to claim 2, wherein said flattened portion is formed integrally with said shaft.

4. The combination paint roller frame and scraper according to claim 2, wherein said flattened portion comprises a flat plate fixed to said shaft.

5. The combination paint roller frame and scraper according to claim 2, wherein said hinge comprises a pair of ears extending from opposing sides of the flattened portion and a hinge pin extending through the ears and the first end of said scraper member.

6. The combination paint roller frame and scraper according to claim 1, wherein said scraper member comprises a flat, planar blade.

7. The combination paint roller frame and scraper according to claim 1, wherein said scraper member is bent, the sharpened second end forming a dihedral angle with the first end of said scraper member.

8. A combination paint roller frame and scraper, comprising:

a paint roller frame having a roller cage assembly, a handle, and a shaft connecting the roller cage assembly to the handle, the shaft having a vertical leg parallel to the handle supporting one end of the roller cage assembly;

an elongated scraper member having a first end and a sharpened second end; and means for pivotally attaching the scraper member to the vertical leg of the shaft, the scraper member pivoting between an open position for use of the combination as a scraper and a closed position for use of the combination as a paint roller.

9. The combination paint roller frame and scraper according to claim 8, wherein said means for pivoting comprises a hinge.

10. The combination paint roller frame and scraper according to claim 9, wherein the vertical leg of said shaft has a flattened portion, said hinge being attached to the flattened portion.

11. The combination paint roller frame and scraper according to claim 10, wherein said flattened portion is formed integrally with said shaft.

12. The combination paint roller frame and scraper according to claim 10, wherein said flattened portion comprises a flat plate fixed to said shaft.

13. The combination paint roller frame and scraper according to claim 10, wherein said hinge comprises a pair of ears extending from opposing sides of the flattened portion and a hinge pin extending through the ears and the first end of said scraper member.

14. The combination paint roller frame and scraper according to claim 8, wherein said scraper member comprises a flat, planar blade.

15. The combination paint roller frame and scraper according to claim 8, wherein said scraper member is bent, the sharpened second end forming a dihedral angle with the first end of said scraper member.

* * * * *